US010077611B2

(12) United States Patent
Civelek et al.

(10) Patent No.: US 10,077,611 B2
(45) Date of Patent: Sep. 18, 2018

(54) FRACTURING TUBE SYSTEM

(71) Applicant: ABORRA AG, Unterengstringen (CH)

(72) Inventors: Resat Civelek, Rüschlikon (CH); Karel Kohlik, Mellingen (CH)

(73) Assignee: ABORRA AG, Unterengstringen (CH)

( * ) Notice: Subject to any disclaimer, the term of this patent is extended or adjusted under 35 U.S.C. 154(b) by 259 days.

(21) Appl. No.: 14/915,310

(22) PCT Filed: Aug. 28, 2014

(86) PCT No.: PCT/EP2014/068269

§ 371 (c)(1),
(2) Date: Feb. 29, 2016

(87) PCT Pub. No.: WO2015/028554

PCT Pub. Date: Mar. 5, 2015

(65) Prior Publication Data

US 2016/0208560 A1 Jul. 21, 2016

(30) Foreign Application Priority Data

Sep. 2, 2013 (CH) ..... 1487/13
Mar. 6, 2014 (CH) ..... 0332/14

(51) Int. Cl.
*F16L 39/02* (2006.01)
*E21B 43/26* (2006.01)
(Continued)

(52) U.S. Cl.
CPC ..... *E21B 17/04* (2013.01); *E21B 17/20* (2013.01); *E21B 19/12* (2013.01); *E21B 19/16* (2013.01); *E21B 41/0021* (2013.01); *E21B 43/26* (2013.01)

(58) Field of Classification Search
CPC . F16L 39/00; F16L 39/02; F16L 39/04; E21B 7/18; E21B 7/20
(Continued)

(56) References Cited

U.S. PATENT DOCUMENTS 3,503,634 A * 3/1970 Cadiou ..... F16L 19/0212 277/609
3,822,903 A * 7/1974 McNeely ..... F16L 39/00 285/124.2
(Continued)

FOREIGN PATENT DOCUMENTS

GB 2410965 8/2005
WO 9822691 5/1998

OTHER PUBLICATIONS

International Search Report dated Nov. 4, 2014 for PCT/EP2014/068269.
(Continued)

*Primary Examiner* — Kenneth L Thompson
(74) *Attorney, Agent, or Firm* — Paul D. Bianco; Fleit Gibbons Gutman Bongini & Bianco PL

(57) ABSTRACT

A fracturing tube system for introducing into a borehole in order to carry out a hydraulic and/or pneumatic fracturing process, including a plurality of tube lines. The fracturing tube system is to be designed such that it can be produced in a simpler and more economical manner and such that a variable total length of the fracturing tube system can be introduced into a borehole with little effort. This is achieved in that the fracturing tube system has at least one traction cable, multiple coupling devices which can be removably attached to the at least one traction cable, and multiple tube sections which are separate from one another and which can be coupled to the coupling devices in a pressure-tight manner and thus form the tube lines as a whole. A pressure-tight releasable connection of the tube sections to feedthroughs of the coupling device can be achieved so that fluid can be conducted from one tube section into a subsequent tube section through the feedthrough in the coupling device in a tube-free manner.

20 Claims, 4 Drawing Sheets

(51) Int. Cl.

| | |
|---|---|
| ***E21B 17/04*** | (2006.01) |
| ***E21B 41/00*** | (2006.01) |
| ***E21B 17/20*** | (2006.01) |
| ***E21B 19/12*** | (2006.01) |
| ***E21B 19/16*** | (2006.01) |

(58) Field of Classification Search
USPC ..... 285/124.1, 124.2, 124.3, 120.1; 294/86.1
See application file for complete search history.

(56) References Cited

U.S. PATENT DOCUMENTS

| | | | | |
|---|---|---|---|---|
| 4,478,278 | A | 10/1984 | Klein | |
| 4,602,658 | A * | 7/1986 | Luther | F16L 39/00 137/614 |
| 4,945,985 | A * | 8/1990 | Lynds | E21B 31/18 166/301 |
| 5,135,265 | A * | 8/1992 | Bouscher | F16L 39/04 138/112 |
| 6,220,351 | B1 | 4/2001 | Tovar De Pablos | |
| 6,481,756 | B1 * | 11/2002 | Field | F16L 29/005 285/120.1 |
| 7,044,232 | B2 | 5/2006 | Jordon et al. | |
| 9,291,008 | B2 * | 3/2016 | Koch | E21B 17/18 |
| 2005/0191889 | A1 | 9/2005 | Jordan et al. | |
| 2010/0206586 | A1 | 8/2010 | Decker et al. | |
| 2015/0361632 | A1 * | 12/2015 | Bonomi | E02D 3/12 405/269 |

OTHER PUBLICATIONS

Written Opinion of the International Searching Authority published Mar. 5, 2015 for PCT/EP2014/068269.
English translation of International Preliminary Report of Patentability published Mar. 8, 2016 for PCT/EP2014/068269.
English translation of Written Opinion of the International Searching Authority published Jan. 1, 2016 for PCT/EP2014/068269.

* cited by examiner prior art

FRACTURING TUBE SYSTEM

TECHNICAL FIELD

The present invention describes a fracturing tube system comprising a plurality of tube lines for being introduced into a bore hole in order to carry out a hydraulic and/or pneumatic fracturing process, as well as the utilization of at least one traction cable, multiple coupling devices that can be removably attached to the at least one traction cable and multiple separate tube sections in the form of corrugated metal tubing with a braiding, which can be coupled to the coupling devices in a pressure-tight fashion and collectively form the tube lines, for assembling a fracturing tube system.

PRIOR ART

Hydraulic fracturing (hydraulic fracturing) and/or pneumatic fracturing, which is generally also referred to as fracking, is used for extracting hydrocarbons, natural gas or crude oil from corresponding subterranean natural gas or oil formations. Among other things, hydraulic and/or pneumatic fracturing also makes it possible to reactivate abandoned natural gas or oil formations and to thereby extract residual amounts of liquid and gaseous fossil fuels that were previously inaccessible, wherein this process is also referred to as intervention.

Natural gas or oil formations usually are subterraneously fractured with the aid of a fracturing fluid in order to create artificial flow channels for the hydrocarbons to be extracted and to thereby simplify the process of pumping off the hydrocarbons. To this end, a multi-lumen tubing has to be purposefully lowered into an existing bore hole for the hydraulic and/or pneumatic fracturing process, wherein this is also referred to as coiled tubing. The multi-lumen tubing is unwound from a drum on-site with a suitable device and lowered into the bore hole to a depth between a few meters and a few kilometers. In this case, the fixed length of the multi-lumen tubing has to be adapted to the desired lowering depth or bore hole depth, respectively. A corresponding system for carrying out hydraulic and/or pneumatic fracturing processes is illustrated in FIG. 6.

Subsequently, the fracturing fluid is hydraulically pumped into the bore hole in a controlled fashion by means of tube lines of the multi-lumen tubing. Since the fracturing fluid not only contains water, but also supporting particles and/or additives that preserve the fractures being produced, the enlarged flow channels leading to the bore hole remain open such that an increased amount of hydrocarbons can be pumped off.

Nowadays, preassembled multi-lumen tubing, which comprises a plurality of prefabricated tube lines in the form of metal tubes that typically have diameters between one inch and 3.25 inches, are used for hydraulic and/or pneumatic fracturing processes. The tube lines are completely encased in a plastic covering and form a flexible, compact tube line cluster. The thusly realized multi-lumen tubing is protected from external influences by the plastic covering, as well as an optional covering of steel cables and another optional plastic covering, wherein the individual tube lines are clustered in an encapsulated fashion at a distance from one another and enclosed by plastic. Such compact and integrally designed multi-lumen tubing can be introduced into a bore hole and is designed for being vertically and horizontally advanced therein.

A preassembled multi-lumen tubing according to the prior art is illustrated in FIG. 7 in the form of a fracturing tube system. In this case, four tube lines with an inside diameter of ¾ inch are enclosed by a plastic covering, as well as two rows of steel cables extending parallel to the circumference of the multi-lumen tubing, wherein an additional plastic covering encloses the two rows of steel cables.

The individual tube lines serve for pumping in or pumping out fracturing fluids and/or for supplying supporting particles and/or additives, as well as for pumping off hydrocarbons. Since an electronically controlled pump device or control device (so-called packer) usually is subterraneously arranged on the multi-lumen tubing, this multi-lumen tubing also features optional electrical wiring that is likewise encased in the plastic covering along the entire length of the preassembled multi-lumen tubing. The fracturing tube system is manufactured with a constant outside diameter and a fixed length and wound on a drum. Since pressures up to 200 bar and temperatures within the bore hole of a few hundred degrees Celsius occur during hydraulic fracturing, the individual tube lines are realized in the form of metal tubes that are able to withstand these conditions.

The manufacture of preassembled multi-lumen tubing known from the prior art is elaborate and expensive. The individual tube lines in the form of metal tubes have to be encased in the plastic covering at a distance from one another over the entire desired length of the multi-lumen tubing and the steel cable-reinforced outer covering also has to be arranged over the entire length of the multi-lumen tubing such that the preassembled fracturing tube system can be wound up on a drum in one piece for its transport and intended use.

During the intended use of the fracturing tube system, this drum, which may have an enormous mass depending on the overall length of the wound-up fracturing tube system, has to be unwound in an exactly controlled fashion by means of a suitable device in order to introduce the fracturing tube system into the bore hole in a controlled fashion.

DISCLOSURE OF THE INVENTION

The present invention is based on the objective of developing a fracturing tube system that can be manufactured in a simpler and more cost-efficient fashion, as well as introduced into a bore hole with a variable overall length and with reduced effort.

The present fracturing tube system no longer has to be supplied in a preassembled fashion with a given overall length, but rather can be modularly assembled and therefore have a variable overall length such that it no longer has to be elaborately wound up on a drum in one piece.

BRIEF DESCRIPTION OF THE DRAWINGS

A preferred exemplary embodiment of the object of the invention is described in greater detail below with reference to the attached drawings.

FIG. 1 shows a schematic front view of a fracturing tube system with several tube lines that are composed of several tube sections and coupled to two coupling devices, wherein the entire fracturing tube system comprises a single traction cable, whereas

FIG. 4*a* shows a sectioned view of a coupling device whereas

FIG. 6 shows a schematic top view of a hydraulic and/or pneumatic fracturing system according to the prior art, in which a fracturing tube system is lowered into a bore hole, whereas

DESCRIPTION

Figure 2:
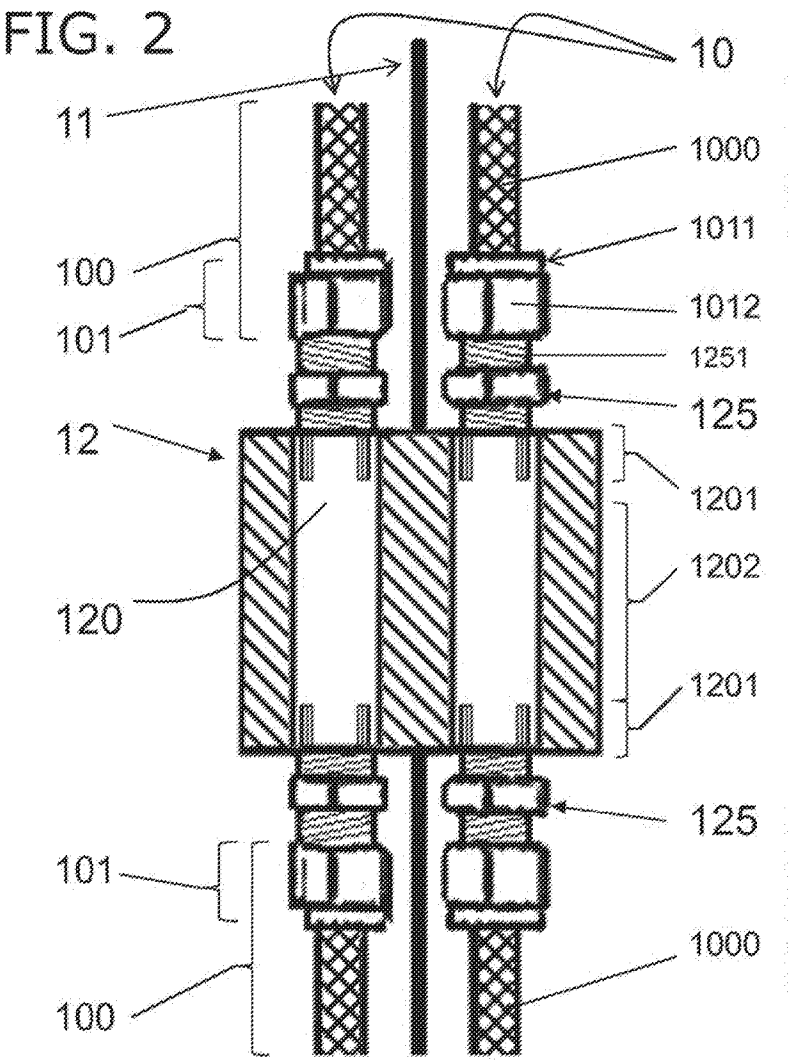
FIG. 2 shows a partially sectioned view of a potential coupling device, in which yet uncoupled tube sections are indicated to both sides of the coupling device.
Figure 1:
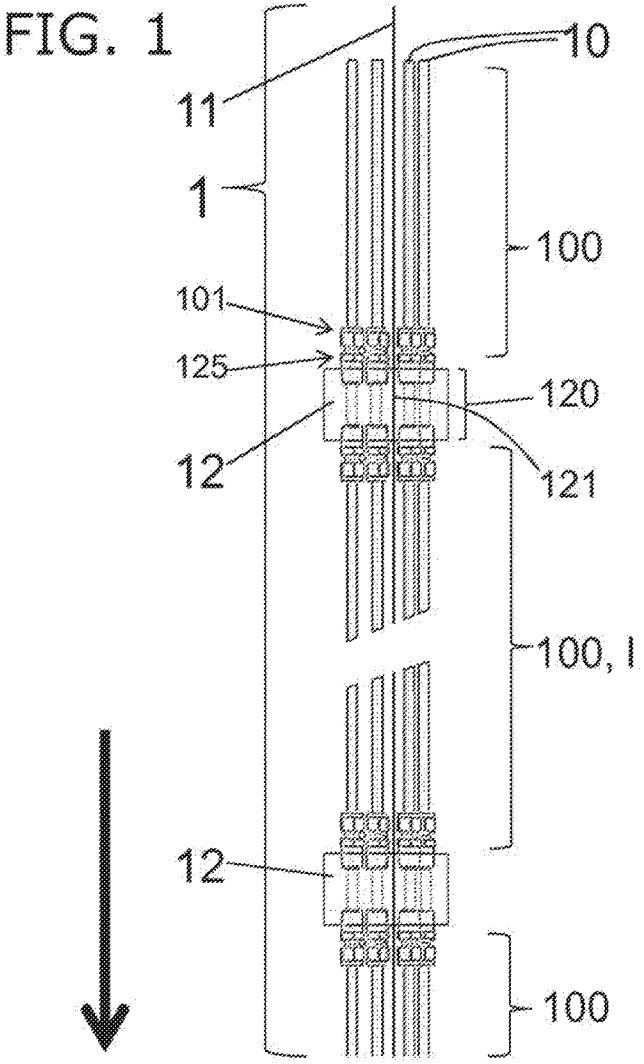

The fracturing tube system 1 presented herein comprises a plurality of tube lines 10 that can be introduced into a not-shown bore hole by means of a traction cable 11. The tube lines 10 are arranged separately and spaced apart from one another, wherein said tube lines are composed of a plurality of separate tube sections 100 that are coupled to a plurality of coupling devices 12. The tube sections 100 are provided with tube coupling means 101 that can be functionally connected to device coupling means 125 such that a pressure-tight separable connection between the tube sections 100 and feedthroughs 120 of the coupling device 12 can be produced and fluid can be conveyed in a tubeless fashion from one tube section 100 into a following tube section 100 through the feedthrough 120 in the coupling device 12. FIG. 1 or 2 respectively shows that the feedthrough 120 is the space in the coupling device 12, through which the fluid flows. After the tube sections 100 have been coupled to the feedthroughs 120 of the coupling device 12, a direct pressure-tight passage is created from the interior of each tube section 100 through the feedthroughs 120. In this way, fracking fluids can be conveyed from outside the bore hole through the entire modular tube line 10 until they reach an outlet at the base of the bore hole. The arrow in FIG. 1 indicates the direction, in which the fracturing tube system 1 is introduced.

The tube sections 100 are held on the coupling devices 12 such that the respective tube sections 100 or tube lines 10 and the coupling devices 12 are held by the traction cable 11. The preferably single traction cable 11 extending over the entire length of the fracturing tube system 1 is respectively routed through a cable feedthrough 121 in or on each coupling device 12 and removably attached to the coupling device 12 at this location. The overall length of the fracturing tube system 1 can be easily adapted.

Additional tube sections 100 with section lengths I can be respectively coupled to additional coupling devices 12 as needed and connected such that the individual tube lines 10 are extended, wherein the length of the traction cable 11 also has to be adapted. Since the transport and the costs of a traction cable 11 are respectively not elaborate or expensive, a sufficiently long traction cable 11 can be chosen before lowering of the modularly designed fracturing tube system 1 begins. This traction cable 11 is unwound from a roll and respectively attached to each coupling device 12.

Corrugated metal tubing is used for the tube sections 100. The corrugated metal tubing is made of steel, preferably of high-grade steel, and therefore extremely resistant to corrosion, wherein this corrugated metal tubing can withstand pressures up to a few hundred bar and temperatures up to 600° C. Consequently, corrugated metal tubing of this type is suitable for hydraulic and/or pneumatic fracturing processes, during which pressures up to 200 bar and occasional temperatures in excess of 200° C. occur. Increased fatigue strength is achieved due to the corrugation of the corrugated metal tubing. Corrugated metal tubing can be used for conveying liquid or gaseous mediums, as well as pumpable solids that are frequently added to the fracturing fluid as an additive.

In order to provide sufficient mechanical protection for the tube sections 100, it is advantageous to provide the tube sections 100 with a braiding 1000. Although it was determined that a single braiding 1000 delivers adequate results during the utilization of the fracturing tube system 1, it is preferred to respectively use a two or more braidings 1000 for strength reasons. The arrangement of one or multiple braidings 1000 increases the bursting pressure of the tube sections 100 and therefore of the entire tube lines 10. The braiding 1000 consists of high-grade steel wire or galvanized steel wire and is directly braided on the circumferential surface of the tube sections 100 of corrugated metal tubing. Braided tube sections 100 of this type are commercially available.

In this case, the tube coupling means 101 on both ends of the tube sections 100 are realized in the form of a flange 1011 and a union nut 1012.

The device coupling means 125 is realized in the form of a double nipple 125. The utilization of a double nipple 125 makes it possible to connect the tube section 100 and the feedthrough 120.

An externally realized thread 1251 of the double nipple 125 can be screwed into one side of the feedthrough 120 of the coupling device 12 whereas the union nut 1012 can be screwed on an additional external thread 1251. In this way, a pressure-tight connection between the tube sections 100 and the feedthroughs 120 is produced.

The partial section through a coupling device 12 illustrated in FIG. 2 shows threaded sections 1201 that respectively feature an internal thread and channel sections 1202 that respectively form the feedthroughs 120 extending within the coupling device 12. An external thread 1251 of the double nipple 125 can be screwed into the threaded section 1201 such that the tube sections 100 can be coupled to the feedthroughs 120 in a pressure-tight fashion. After the modularly designed tube lines 10 have been assembled, the fracking fluid can be pumped through the tube sections 100, the feedthrough 120 in the coupling device 12 and through additional tube sections 100.

Figure 3:
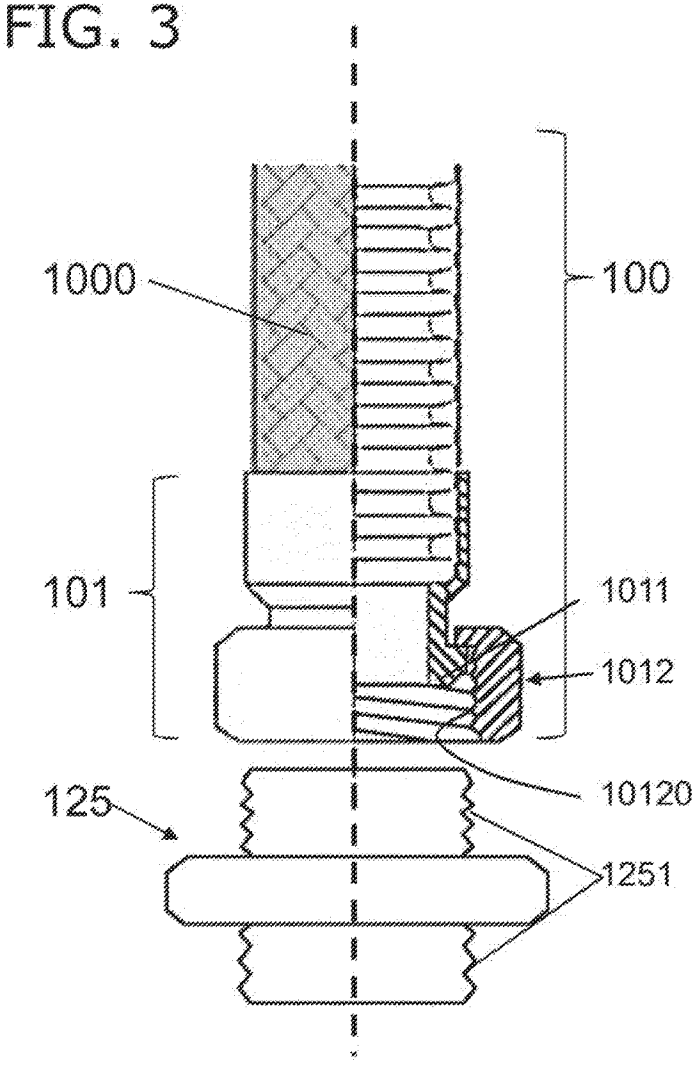
FIG. 3 shows a partially sectioned view of a tube section, tube coupling means and device coupling means prior to the coupling process.

The tube sections 100 used in this case are illustrated in a partially sectioned fashion in FIG. 3 and realized in the form of corrugated metal tubing with annular corrugation. However, it is also possible to use corrugated metal tubing with helical corrugation. In this case, the braiding 1000 is preferably realized in the form of a double braiding 1000 that shields the corrugated outer surface of the tube sections 100.

The internal thread 10120 of the union nut 1012 is screwed on the external thread 1251 of the double nipple 125 manually and subsequently tightened with a wrench, wherein the flange 1011 is flanged on the double nipple 125 with or without an additional seal. In this case, the double nipple 125 features a thickening in the form of a hexagon such that the double nipple 125 also can be easily fastened in the threaded section 1201 of the feedthrough 120 in a removable fashion by means of a wrench.

The exemplary coupling option shown, in which a double nipple 125 is used as device coupling means 125, may also be realized differently. It would be possible, for example, use coupling sleeves or the coupling device 12 may feature rigid connecting pieces, on which the tube coupling means 101 can be positively and/or non-positively fastened in a removable fashion. These connecting pieces may be integrally formed or welded on and thereby integrally connected to the coupling device 12. A simple and quick coupling should be achieved, wherein it is advantageous to forgo device coupling means 125, tube coupling means 101 and additional seals of plastic because plastics are negatively affected by the temperatures occurring during hydraulic and/or pneumatic fracturing.

Figure 4A:
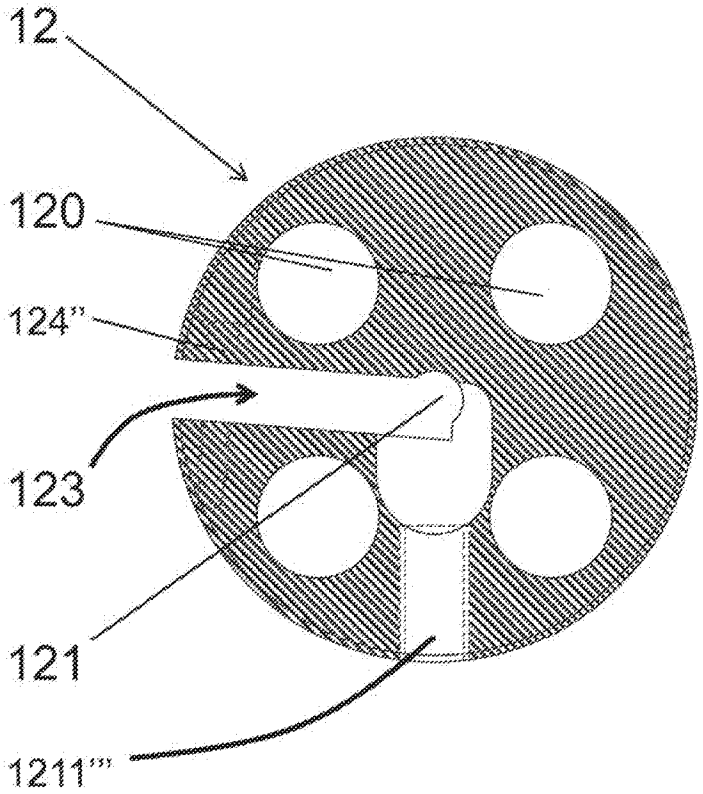

FIG. 4*a* shows a section through a coupling device 12, in which the device coupling means 125 and the tube sections 100 were omitted in order to provide a better overview. The cylindrically designed coupling device 12 shown features a cable feedthrough 121 in the form of a central through-bore extending in the direction of the longitudinal cylinder axis. A traction cable 11 can be placed into this cable feedthrough 121, wherein said traction cable can be inserted through an insertion slot 123. In this case, the insertion slot 123 is realized about radially referred to the centrally extending cable feedthrough 121 and extends through the entire body of the coupling device 12.

Cable fastening means 1211 are provided for attaching the traction cable 11. The cable fastening means shown consist of a recess 1211''', through which a threaded pin 1211" can be inserted.

Since significant tensile forces act upon the coupling device 12 when the traction cable 11 is inserted and attached and the tube sections 10 are in the coupled state, a slot safety 124 is provided in order to absorb forces acting upon the insertion slot 123 or the slotted coupling device 12 in the region of the insertion slot 123 and to thereby protect the coupling device 12 against distortion. Furthermore, the slot safety 124 additionally secures an attached traction cable 11 from sliding out of the coupling device 12.

Figure 5:
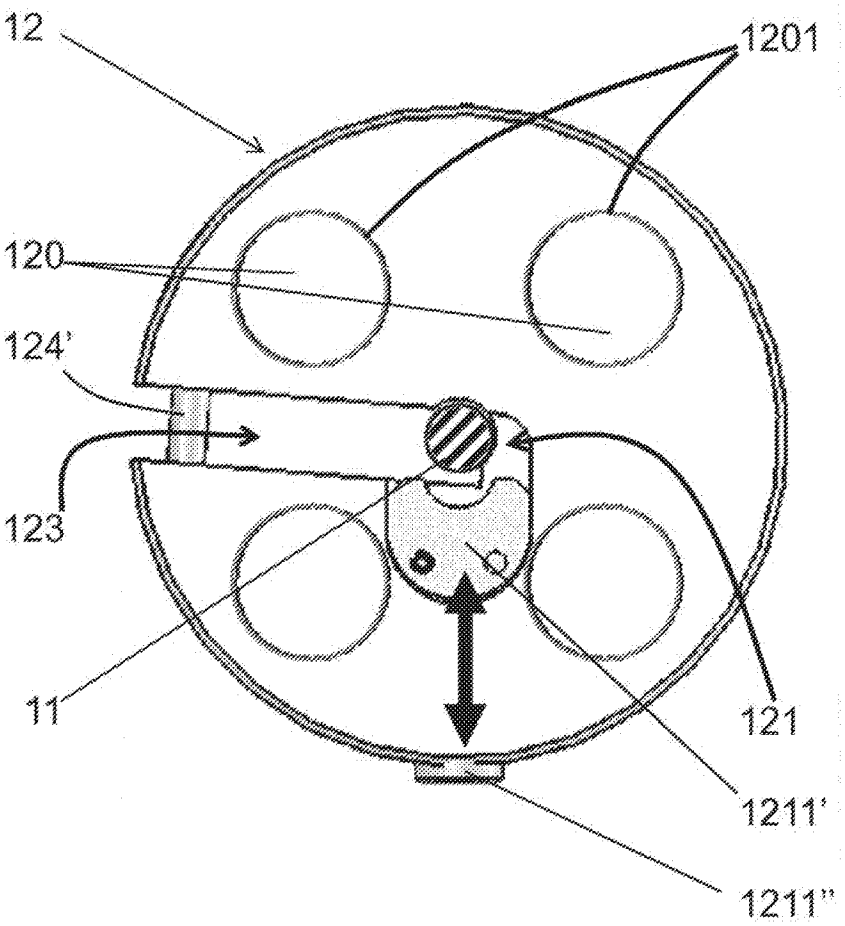
FIG. 5 shows a sectioned top view of a coupling device with inserted traction cable, but without tube sections flanged thereon, wherein the traction cable is not yet fastened in the cable leadthrough.

In this case, the slot safety 124 features a bore 124" and a safety screw 124' that can be screwed through the slot safety 124; see FIG. 5.

Figure 4B:
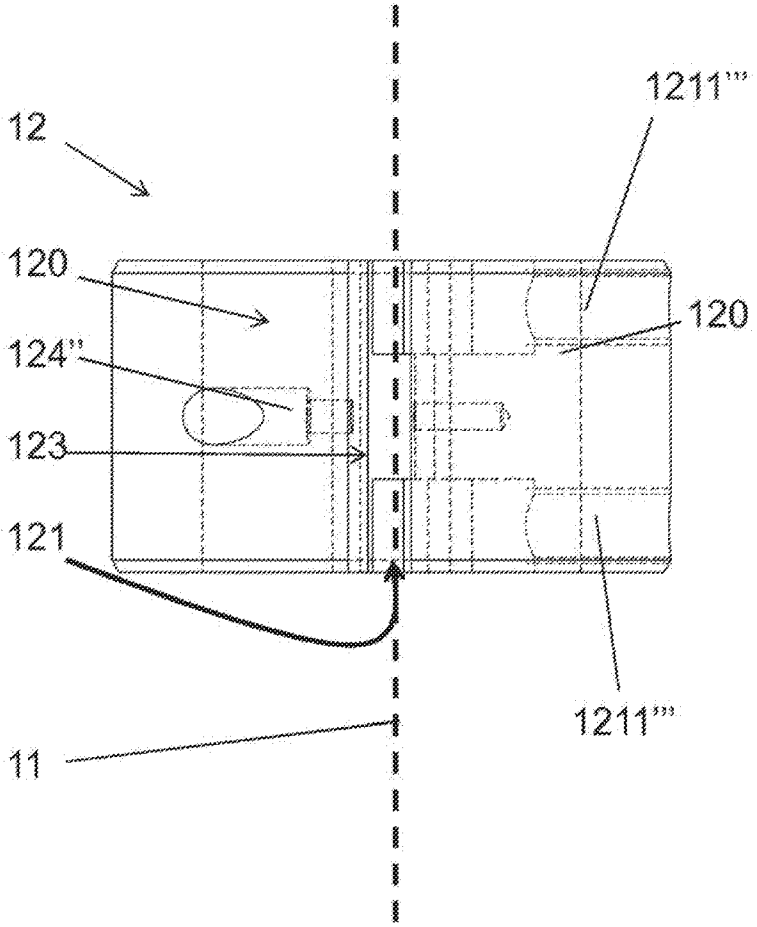
FIG. 4*b* shows a side view of the coupling device.
Figure 7:
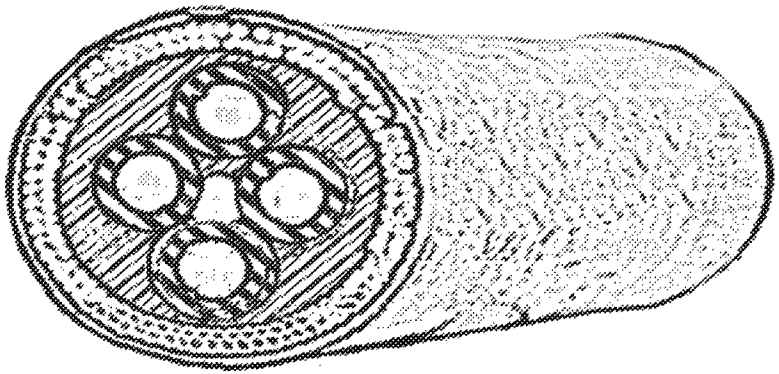
FIG. 7 shows a sectional view of a fracturing tube system according to the prior art in the form of a multi-lumen tubing.
Figure 6:
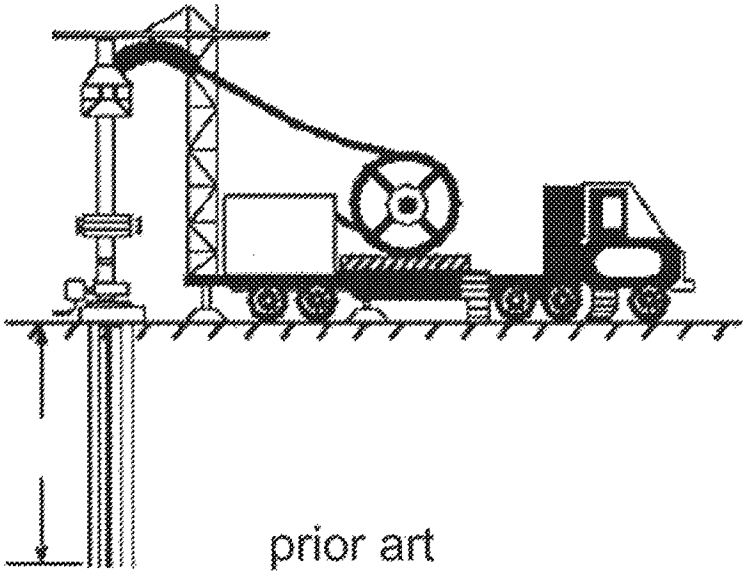
prior art FIG. 6

In the side view of a coupling device 12 illustrated in FIG. 4*b*, the traction cable 11 extending in the direction of the cylinder axis is indicated with a broken line. The traction cable 11 is laterally inserted into the coupling device 12 through the insertion slot 123 until it is positioned in the central cable feedthrough 121. This figure shows two recesses 1211''', by means of which the traction cable 11 can be held in two positions in the cable feedthrough 121.

FIG. 5 shows a top view of the coupling device 12, in which the inserted traction cable 11 is illustrated in a sectioned fashion. A clamping element 1211' is linearly screwed in about perpendicular to the longitudinal axis of the coupling device 12 by means of the threaded pin 1211" traversing the recess 1211''' such that the inserted traction cable 11 is clamped in position. The clamping direction is indicated with a double arrow in FIG. 5.

The fracturing tube system 1 described herein can be assembled by lowering a first coupling device 12 with first tube sections 100 coupled thereto and the traction cable 11 fastened thereon into a bore hole. The ends of the first tube sections 100 on the introduction side are coupled to a second coupling device 12 and the traction cable 11 is inserted through the insertion slot 123 of the second coupling device 12 and removably attached to the cable feedthrough 121. Subsequently, second tube sections 100 can be attached to the second coupling device 12 such that the second coupling device 12, as well as the second tube sections 100, can be lowered into the bore hole with the aid of the traction cable 11. If the base of the bore hole is not yet reached, the fracturing tube system 1 can be extended to the desired overall length by connecting additional coupling devices 12 and tube sections 100 to one another and to a traction cable 11.

The fracturing tube system 1 preferably features a continuous one-piece traction cable 11. However, it would also be conceivable to divide the traction cable 11 into cable sections such that it can be extended to a desired overall length of the fracturing tube system 1. However, this would reduce the stability of the traction cable 11 and could potentially lead to undesirable twisting, which cannot be readily prevented.

In this case, the traction cable 11 used consists of a steel cable or high-grade steel cable with a diameter of at least ten millimeters. Such a traction cable 11 is capable of absorbing the tensile forces of four tube sections 100 with a respective length of about one hundred meters.

In order to additionally protect the individual tube sections 100 against abrasion, a protective helix of steel or high-right steel may furthermore be wound over the circumference of the tube sections 100. This spirally wound protective helix can be fastened in the coupling part of the tube sections 100. In addition to the use of a protective helix, a person skilled in the art is familiar with other suitable protection options.

The tube sections 100 may furthermore consist of multilayer plastic tubes that are resistant to hydrocarbons. Plastic tubes of this type are familiar to a person skilled in the art and can be used with or without braiding.

Instead of the functional connection between the tube sections 100 and the coupling device 12 described herein, it would also be possible to produce the connection by means of hydraulic rapid-action coupling. Since the tensile force acting upon the tube sections 100 is absorbed by the traction cable 11 in this case, it is also possible to use hydraulic rapid-action couplings that cannot be subjected to tensile loads.

LIST OF REFERENCE SYMBOLS

- 1 Fracturing tube system
  - 10 Tube line (composed of four or more sections)
    - 100 Tube section
      - I Section length
      - 1000 Braiding/braid
    - 101 Tube coupling means
      - 1011 Flange
      - 1012 Union nut
        - 10120 Internal thread
  - 11 Traction cable/steel cable (one)
  - 12 Coupling device
    - 120 Feedthrough (four or more)
      - 1201 Threaded section (internal thread)
      - 1202 Channel section (cylindrical)
    - 121 Cable feedthrough (central through-bore)
      - 1211 Cable fastening means
        - 1211' Clamping element
        - 1211" Threaded pin
        - 1211''' Recess
    - 123 Insertion slot
    - 124 Slot safety
      - 124' Safety screw
      - 124" Bore
    - 125 Device coupling means/double nipple
    - 1251 External thread

The invention claimed is:

1. A fracturing tube system for a hydraulic or a pneumatic fracturing process, the fracturing tube system comprising:

a plurality of tube lines arranged separately and spaced apart from one another, each tube line of the plurality of tube lines composed of a plurality of tube sections coupled to a plurality of coupling devices; and at least one traction cable for introducing the plurality of tube lines into a borehole, the at least one traction cable removably couplable to each coupling device of the plurality of coupling devices and extendable along an entire longitudinal length of the fracturing tube system;

wherein the coupling devices are coupled to or uncoupled from the at least one traction cable to add or to subtract tube sections to adjust an overall length of the tube fracturing system.

2. The fracturing tube system according to claim 1, wherein each tube section of the plurality of tube sections is a corrugated metal tube having an annular or helical corrugation, the corrugated metal tube reinforced by at least one braiding arranged on an outer surface.

3. The fracturing tube system according to claim 2, wherein the corrugated metal tube is reinforced by two or more braidings arranged on the outer surface.

4. The fracturing tube system according to claim 2, wherein the metal is steel.

5. The fracturing tube system according to claim 1, wherein each tube section of the plurality of tube sections is a multilayer plastic tube resist to hydrocarbons.

6. The fracturing tube system according to claim 1, wherein each coupling device of the plurality of coupling devices includes feedthrough spaces configured for fluid flow.

7. The fracturing tube system according to claim 6, wherein each of the plurality of tube sections includes tube coupling elements at each end, the tube coupling elements configured for coupling to device coupling elements formed on the coupling devices to form pressure-tight connections between the feedthrough spaces such that fluid is conveyed from one tube section into a next coupled tube section through the feedthrough spaces.

8. The fracturing tube system according to claim 6, wherein the device coupling elements are integral to the coupling devices or are separately connectable to the coupling devices.

9. The fracturing tube system according to claim 8, wherein the device coupling elements are in a form of a double nipple and the tube coupling elements are in a form of a flange and a union nut.

10. The fracturing tube system according to claim 9, wherein each double nipple is connected at one end to a feedthrough space by engagement of an external thread with a threaded portion of the feedthrough space and is connected at the other end by engagement with the flange and union nut.

11. The fracturing tube system according to claim 7, wherein the tube coupling elements and the device coupling elements are configured for hydraulic rapid-action coupling.

12. The fracturing tube system according to claim 1, wherein each coupling device of the plurality of coupling devices includes a cable feedthrough for receiving the at least one traction cable, the cable feedthrough arranged such that the at least one traction cable extends through a center of the coupling device.

13. The fracturing tube system according to claim 12, wherein each coupling device of the plurality of coupling devices includes an insertion slot for receiving the at least one traction cable, the insertion slot extending radially from the cable feedthrough through the coupling device in a longitudinal direction.

14. The fracturing tube system according to claim 13, wherein each coupling device of the plurality of coupling devices includes a slot safety formed as a bore and a safety screw configured for screwing into the bore, the bore partially transversing the coupling device in the insertion slot.

15. The fracturing tube system according to claim 12, wherein each coupling device of the plurality of coupling devices includes a cable fastening element, the cable fastening element configured for removably attach the at least one traction cable to the cable feedthrough.

16. The fracturing tube system according to claim 15, wherein the cable fastening element is a clamping element for clamping the at least one traction cable to the cable feedthrough, the clamping element configured for engaging a recess in the coupling device with a threaded pin.

17. A method for a hydraulic or a pneumatic fracturing process, the method comprising:

assembling the fracturing tube system according to claim 1;

introducing the plurality of tube lines into the borehole; and pumping fluid through at least one tube line of the plurality of tube lines.

18. A fracturing tube system for a hydraulic or a pneumatic fracturing process, the fracturing tube system comprising:

a plurality of tube lines arranged separately and spaced apart from one another, each tube line of the plurality of tube lines composed of a plurality of tube sections coupled to a plurality of coupling devices;

a plurality of feedthrough spaces in each coupling device of the plurality of coupling devices, the feedthrough spaces configured for fluid flow;

at least one traction cable for introducing the plurality of tube lines into a borehole; and a cable feedthrough in each coupling device of the plurality of coupling devices, the cable feedthrough for receiving the at least one traction cable;

wherein the at least one traction cable is removably couplable to each coupling device of the plurality of coupling devices and extends through the cable feedthrough in a center of the coupling devices along an entire longitudinal length of the fracturing tube system; and wherein the coupling devices are coupled to or uncoupled from the at least one traction cable to add or to subtract tube sections to adjust an overall length of the tube fracturing system.

19. The fracturing tube system according to claim 18, wherein each of the plurality of tube sections includes tube coupling elements at each end, the tube coupling elements configured for coupling to device coupling elements formed on the coupling devices to form pressure-tight connections between the feedthrough spaces such that fluid is conveyed from one tube section into a next coupled tube section through the feedthrough spaces.

20. A method for a hydraulic or a pneumatic fracturing process, the method comprising:

assembling the fracturing tube system according to claim 18;

introducing the plurality of tube lines into the borehole; and pumping fluid through at least one tube line of the plurality of tube lines.

* * * * *